US011827251B2

(12) United States Patent
Feng et al.

(10) Patent No.: US 11,827,251 B2
(45) Date of Patent: Nov. 28, 2023

(54) RAIL VEHICLE AND BOGIE

(71) Applicant: CRRC QINGDAO SIFANG CO., LTD., Shandong (CN)

(72) Inventors: Yonghua Feng, Shandong (CN); Mingxing Li, Shandong (CN); Hao Yin, Shandong (CN); Xin Yang, Shandong (CN); Junfeng Zhou, Shandong (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 0 days.

(21) Appl. No.: 17/781,042

(22) PCT Filed: Apr. 7, 2021

(86) PCT No.: PCT/CN2021/085786
§ 371 (c)(1),
(2) Date: May 30, 2022

(87) PCT Pub. No.: WO2022/110609
PCT Pub. Date: Jun. 2, 2022

(65) Prior Publication Data

US 2023/0132924 A1 May 4, 2023

(30) Foreign Application Priority Data

Nov. 24, 2020 (CN) ..... 202011332469.7
Nov. 24, 2020 (CN) ..... 202022741207.8

(51) Int. Cl.
*B61F 3/04* (2006.01)
*B61F 5/30* (2006.01)
(Continued)

(52) U.S. Cl.
CPC ..... *B61F 5/301* (2013.01); *B61C 9/00* (2013.01); *B61F 3/04* (2013.01); *B61F 5/305* (2013.01); *B61F 5/308* (2013.01); *B61F 5/52* (2013.01)

(58) Field of Classification Search
CPC .. B61F 5/301; B61F 3/04; B61F 5/305; B61F 5/308; B61F 5/52; B61F 5/04; B61F 5/26;
(Continued)

(56) References Cited

U.S. PATENT DOCUMENTS 3,913,495 A * 10/1975 Pelabon ..... B61F 5/20 105/208
2009/0133599 A1* 5/2009 Aitken ..... B61F 5/301 105/168
(Continued)

FOREIGN PATENT DOCUMENTS

CN 102963388 A 3/2013
CN 108909762 A 11/2018
(Continued)

OTHER PUBLICATIONS

CN-111216756 (English translation) (Year: 2020).*
International Search Report for PCT/CN2021/085786 dated May 17, 2021, ISA/CN.

*Primary Examiner* — Mark T Le
(74) *Attorney, Agent, or Firm* — Yue (Robert) Xu; Apex Attorneys at Law, LLP

(57) ABSTRACT

A bogie of a rail vehicle includes a frame, which includes two box-shaped longitudinal beam main bodies and a transverse beam main body; a wheelset, which includes an axle box, an axle and wheels mounted at two ends of the axle; a drive system, which at least includes a gearbox and a drive motor. Practice has proved that the two axle boxes arranged on the inner sides of the two longitudinal beam main bodies
(Continued)

can reduce a volume by about 10%, and reduce a weight by about 10% to 15%, which can further reduce air resistance, and realize energy saving and emission reduction. The longitudinal beam main body is located on an inner side of a wheel, a span of the two the longitudinal beam main bodies is reduced, and the torsional rigidity of the frame is reduced, which is beneficial to improving a curve passing capacity.

16 Claims, 12 Drawing Sheets

(51) Int. Cl.
*B61C 9/00* (2006.01)
*B61F 5/52* (2006.01)

(58) Field of Classification Search
CPC .... B61F 5/16; B61F 5/14; B61F 5/144; B61C 9/00
See application file for complete search history.

(56) References Cited

U.S. PATENT DOCUMENTS

| | | | | |
|---|---|---|---|---|
| 2014/0261061 | A1 | 9/2014 | Chu et al. | |
| 2018/0043910 | A1* | 2/2018 | Hubmann | B61F 5/52 |
| 2019/0031210 | A1* | 1/2019 | Falkenstein | B61F 3/04 |
| 2020/0094857 | A1* | 3/2020 | Zhang | B61F 1/14 |
| 2020/0207381 | A1* | 7/2020 | Cepak | B61C 9/50 |

FOREIGN PATENT DOCUMENTS

| | | | | | |
|---|---|---|---|---|---|
| CN | 111216756 | A | * | 6/2020 | B61F 5/14 |
| CN | 210707404 | U | | 6/2020 | |
| CN | 112277993 | A | | 1/2021 | |
| EP | 0308616 | B1 | * | 3/1992 | |
| JP | 2006142987 | A | | 6/2006 | |
| WO | 2019119265 | A1 | | 6/2019 | |

* cited by examiner

RAIL VEHICLE AND BOGIE

This application is a National Phase entry of PCT Application No. PCT/CN2021/085786, filed on Apr. 7, 2021 claims the benefit of priorities to the following two Chinese patent applications, both of which are incorporated herein by reference, 1) Chinese Patent Application No. 202011332469.7, titled "RAIL VEHICLE AND BOGIE", filed with the China National Intellectual Property Administration on Nov. 24, 2020; and
2) Chinese Patent Application No. 202022741207.8, titled "RAIL VEHICLE AND BOGIE", filed with the China National Intellectual Property Administration on Nov. 24, 2020.

FIELD

The present application relates to the technical field of rail vehicles, and in particular to a rail vehicle and a bogie.

BACKGROUND

A bogie is an important part of a rail vehicle, which serves for load bearing, force transmission, buffering and guiding Therefore, the structure performance of the bogie directly determines the traction capacity, operation quality of the rail vehicle and the safety and stability of the rail vehicle.

The bogie mainly includes a frame, a suspension device, a drive device, a basic braking device, and a wheelset. Wheels of the wheelset directly transmit a weight of the rail vehicle to a steel rail, a traction force and a braking force are generated through contact of the wheels and the steel rail, and a traveling guidance of the vehicle on a line is realized through the rotation of the wheelset. The frame is a skeleton part of the bogie, which is used to mount parts of the bogie, bear and transmit vertical and horizontal forces. The suspension device plays a role in mitigating shock and vibration. The drive device can transmit the power generated by a power device to the wheels. In addition, the basic braking device realizes train braking by increasing the transmission of a brake cylinder by a certain ratio and transmitting it to an executing mechanical mechanism.

How to improve the performance of the bogie while ensuring the high-speed traveling stability of the train, especially to meet the needs of a small traveling environment, is an urgent problem for those skilled in the art.

SUMMARY

A bogie with a small volume and suitable for a rail vehicle with a small traveling space is provided according to the present application.

A bogie of a rail vehicle is provided according to the present application, which includes the following components:

- a frame, which includes two box-shaped longitudinal beam main bodies and a transverse beam main body, where the two longitudinal beam main bodies are welded to two ends of the transverse beam main body, and the transverse beam main body and the two longitudinal beam main bodies form an H-shape;
- a wheelset, which includes an axle box, an axle and wheels mounted at two ends of the axle, the two longitudinal beam main bodies are located between the wheels of the wheelset, and the axle box is positioned on an inner side of the longitudinal beam main body by a primary suspension device;
- a drive system, which comprises at least a gearbox and a drive motor, after components constituting the drive system form as a whole, the whole is positioned on the frame by an elastic suspension mechanism.

In the present application, the frame is configured such that the box body has the H-shape structure, the two axle boxes are located on the corresponding inner sides of the two longitudinal beam main bodies, which can reduce a transverse spacing size. Practice has proved that the two axle boxes arranged on the inner sides of the longitudinal beam main bodies can reduce a volume by about 10%, and reduce a weight by about 10% to 15%, which can further reduce air resistance, and realize energy saving and emission reduction. The two longitudinal beam main bodies are located on inner sides of the wheels, and a span of the two the longitudinal beam main bodies is reduced, and the torsional rigidity of the frame is reduced, which is beneficial to improving a curve passing capacity. In addition, the drive system forms vibration decoupling with the frame by the elastic suspension mechanism, which has a high stability.

In addition, a rail vehicle is provided according to the present application, which includes a bogie and a vehicle body, and the bogie is the bogie of the rail vehicle according to any one of the above.

The rail vehicle according to the present application includes the above bogie, and the rail vehicle also has the above technical effect of the bogie.

BRIEF DESCRIPTION OF THE DRAWINGS

FIG. 11 is a schematic sectional view of a drive system in an embodiment of the present application;

Figure 1:
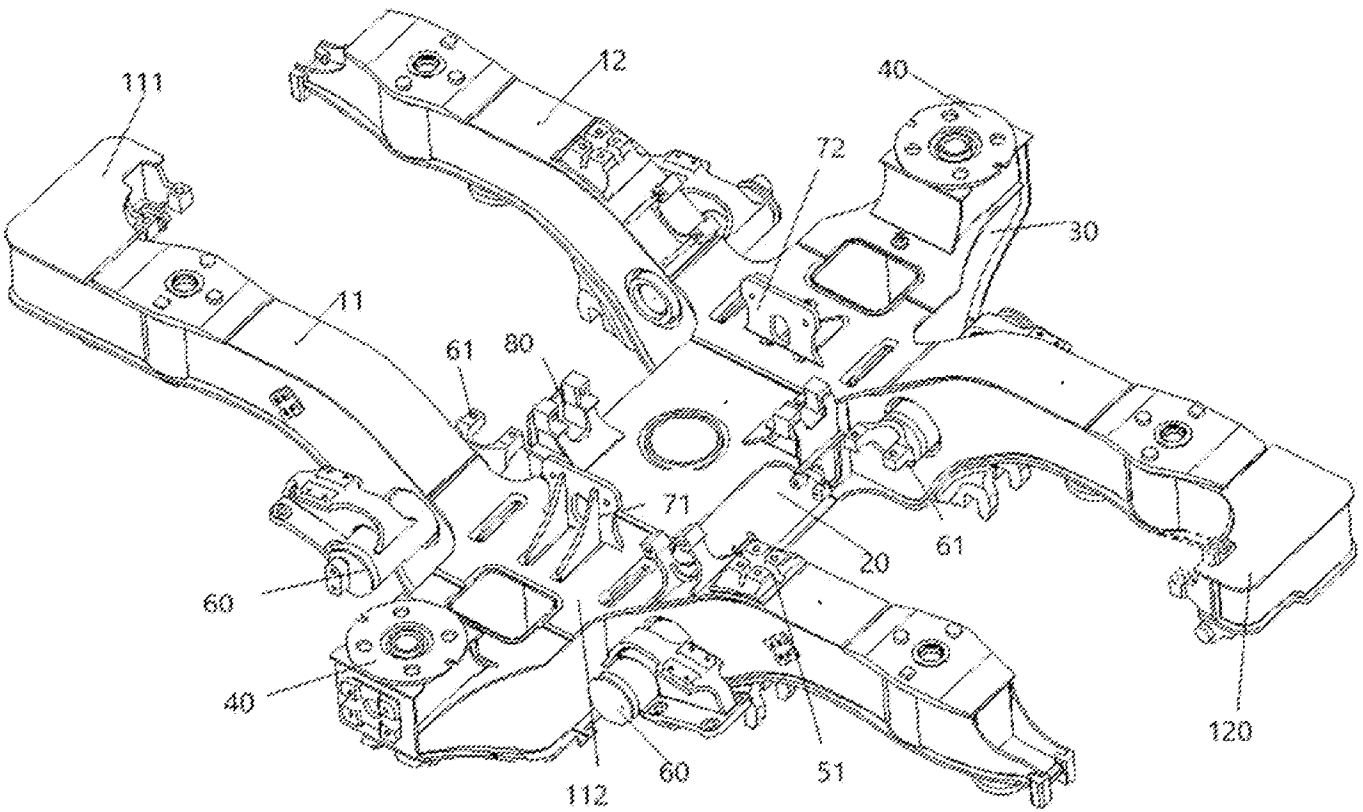
FIG. 1 is a schematic structural view of a frame in a specific embodiment of the present application.

A one-to-one correspondence relationship between reference numerals and various components in FIG. 1 to FIG. 13 is as follows:

| | |
|---|---|
| 11, first longitudinal beam main body; | |
| 111, bending box body section of first longitudinal beam main body; | |
| 112, first upper cover plate; | 12, second longitudinal beam main body; |
| 120, bending box body section of second | longitudinal beam main body; |
| 121, second upper cover plate; | 1211, first inner extension section; |
| 122, lower cover plate; | 1221, second inner extension section; |
| 20, transverse beam main body; | 21, upper plate body; |
| 211, first extending portion; | 22, lower plate body; |
| 221, second extending portion; | 23, vertical plate; |
| 24, reinforcing rib; | 231, extending section; |
| 30, additional box body; | 40, air spring mounting seat; |
| 40, air spring; | 50, second gearbox mounting seat; |
| 53, motor hanger; | 60, supporting column; |
| 61, first gearbox mounting seat; | 62, brake hanger; |
| 63, height valve mounting seat; | 71, first transverse stop block; |
| 72, second transverse stop block; | 80, traction pulling rod seat; |
| 81, motor transverse shock absorber seat; | 82, motor transverse stop seat; |
| 821, first plate; | 822, second plate; |
| 821a, hoisting hole; | 90, spring sleeve; |
| 8-0, drive system; | 8-1, drive motor; |
| 8-2, input end coupling; | 8-3, bearing, |
| 8-4, input end; | 8-6, end surface tooth; |
| 8-7, output end coupling; | 8-8, gearbox. |
| 1, frame; | 2, axle box; |
| 2-1, mounting protruding column, | 3, spring assembly; |
| 31, main spring; | 32, limiting rod; |
| 321, limiting block, | 33, upper mounting plate; |
| 331, column body; | 4, rubber assembly; |
| 41, rubber body; | 411, rubber block; |
| 412, rigid body; | 42, framework; |
| 43, rigid sleeve; | 44, screw; |
| 5, pulling rod; | 6-1, first hinge seat; |
| 6-2, second hinge seat; | 601, elastic body; |
| 7, active vertical shock absorber; | 7-0, wheelset; |
| 5-0, central traction device. | |

DETAILED DESCRIPTION OF THE EMBODIMENTS

In order to provide those skilled in the art a better understanding of the solutions of the present application, the present application is described hereinafter in further detail in conjunction with the drawings and embodiments.

Referring to FIG. 1 to FIG. 13, a rail vehicle at least includes a frame 1, a wheelset 7-0, a drive system 8-0, a central traction device 5-0, a basic braking device and a primary suspension device.

The wheelset directly transmits a weight of the rail vehicle to a steel rail, a traction force and braking force are generated through contact of the wheels and the steel rail, and a traveling guidance of the vehicle on a line is realized through the rotation of the wheelset. The frame is a skeleton part of the bogie, which is used to mount parts of the bogie, bear and transmit vertical and horizontal forces. The suspension device plays a role in mitigating shock and vibration. The drive device can transmit the power generated by a power device to the wheelset. In addition, the basic braking device realizes train braking by increasing the transmission of a brake cylinder by a certain ratio and transmitting it to an executing mechanical mechanism.

The frame in a bogie of a rail vehicle according to the present application includes two box-shaped longitudinal beam main bodies and a transverse beam main body 20. The two longitudinal beam main bodies are respectively welded to two ends of the transverse beam main body 20, and the transverse beam main body 20 and the two longitudinal beam main bodies form an H-shape. The transverse beam main body 20 herein preferably has a box-shaped structure, and a specific structure of the frame formed by the transverse beam main body 20 and the two longitudinal beam main bodies may be described in detail hereinafter.

The wheelset according to the present application includes an axle box 2, an axle and wheels mounted at two ends of the axle, that is, the two ends of the axle are respectively provided with a first wheel and a second wheel, the two longitudinal beam main bodies are located between the two wheels, that is, the two wheels are located on corresponding outer sides of the two longitudinal beam main bodies. The two longitudinal beam main bodies are located on inner sides of the two wheels, a span of the two longitudinal beam main bodies is reduced, and the torsional rigidity of the frame is reduced, which is beneficial to improving a curve line passing capacity.

Besides, the axle box 2 is positioned on an inner side of the longitudinal beam main body by a primary suspension device. Generally, the wheels at two ends of a same axle correspond to one axle box 2, and two axle boxes 2 are located on the corresponding inner sides of the two longitudinal beam main bodies. Such arrangement can reduce a transverse spacing size. Practice has proved that the two axle boxes arranged on the inner sides of the two longitudinal beam main bodies can reduce a volume by about 10%, and reduce a weight by about 10% to 15%, which can further reduce air resistance, and realize energy saving and emission reduction.

A drive system according to the present application includes a gearbox 8-8 and a drive motor 8-1. After components constituting the drive system 8-0 form as a whole, the whole is positioned on the frame 1 by an elastic suspension mechanism. The drive system 8-0 is mounted by elastic suspension and forms vibration decoupling with the frame, which is beneficial to realizing the decoupling of the weight between large springs and improving the critical speed.

Referring to FIG. 11, in a specific embodiment, the drive system further includes an input end coupling 8-2, a bearing 8-3 and an output end coupling 8-7; the input end coupling 8.2 is fixed to an output end of the drive motor 8-1, the input end coupling 8-2 and an input end 8-4 of the gearbox 8-8 are supported by the same bearing 8-3; in this structure, the couplings and the input end 8-4 of the gearbox are supported on the frame by the same bearing 8-3, which further reduces the space occupation.

Furthermore, end surface teeth 8-6 for meshing with a corresponding end of the output end coupling 8-7 are provided on an end surface of an output gear shaft of the gearbox 8-8, and an output end of the gearbox 8-8 is meshed with the external output end coupling, which greatly reduces the space occupation and is beneficial to further realizing the compact structure of the bogie.

Figure 4:
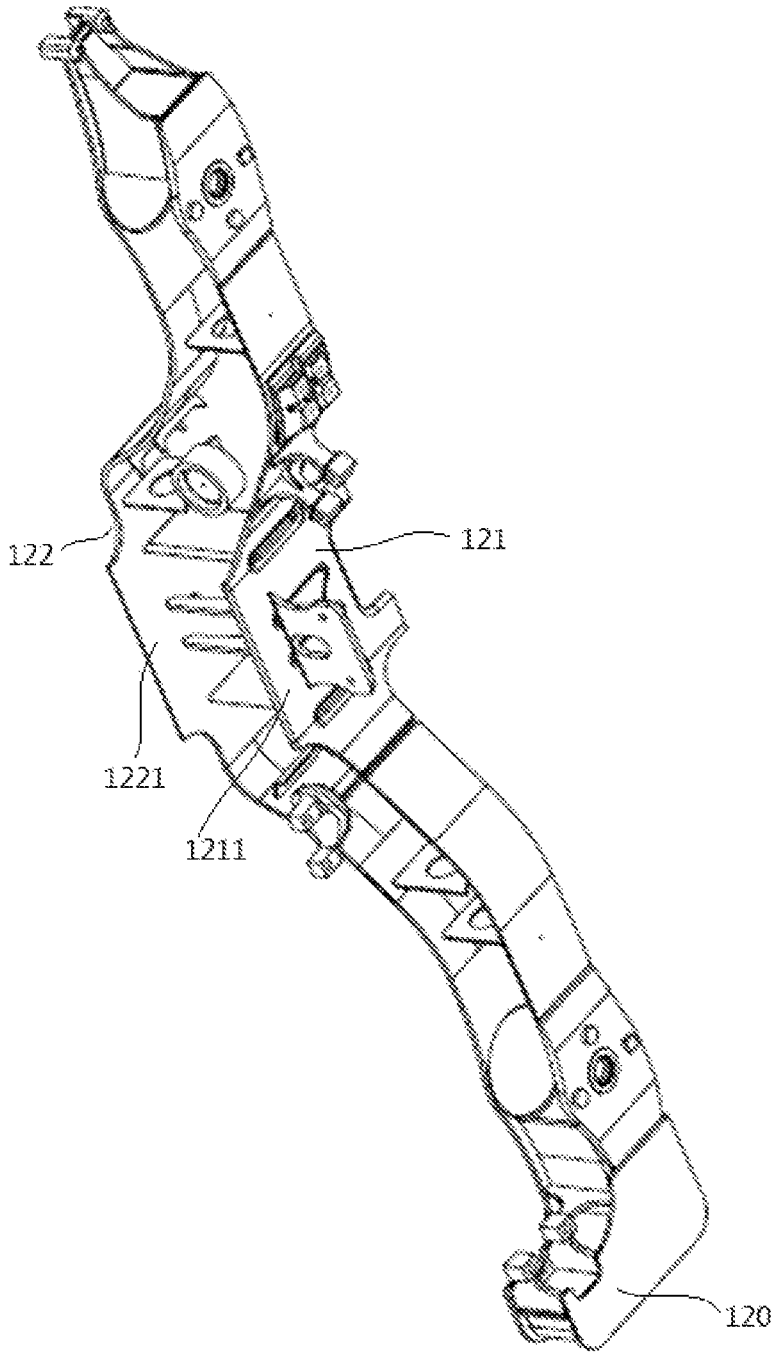
FIG. 4 is a schematic view of a longitudinal beam main body in a specific embodiment of the present application.
Figure 12:
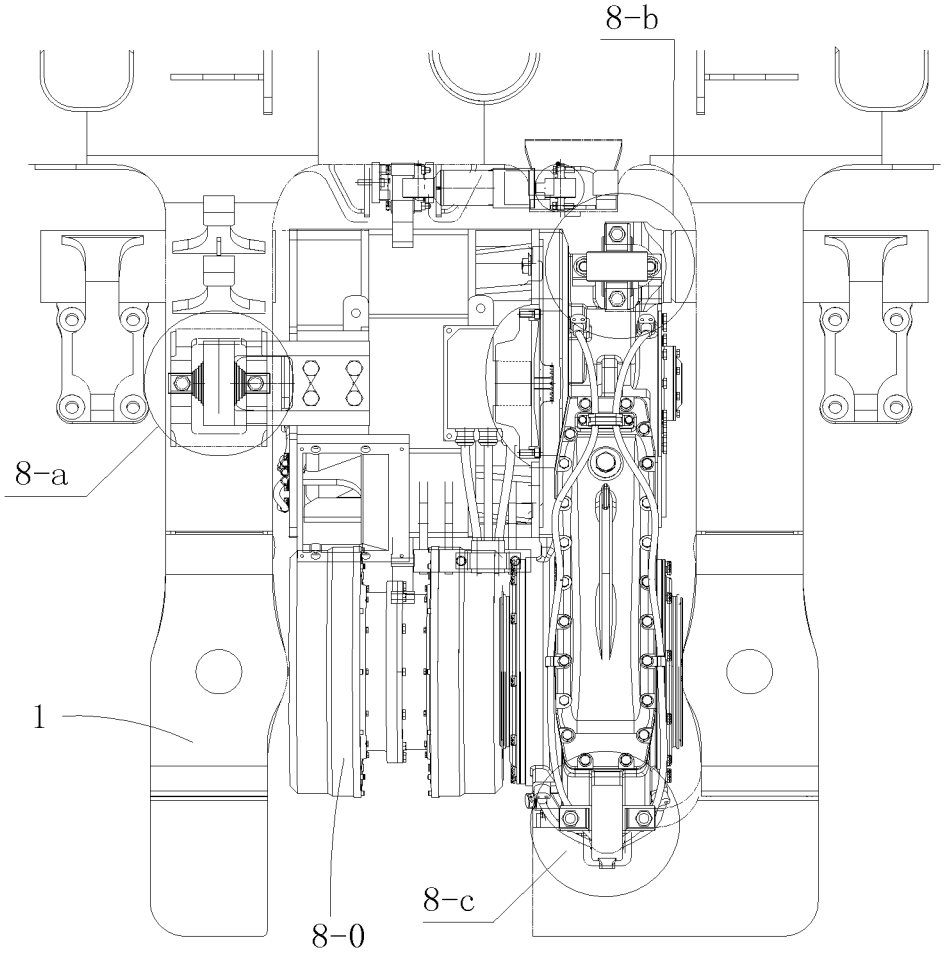
FIG. 12 is a schematic view of an arrangement of an elastic suspension mechanism in the drive system in an embodiment of the present application.
Figure 13:
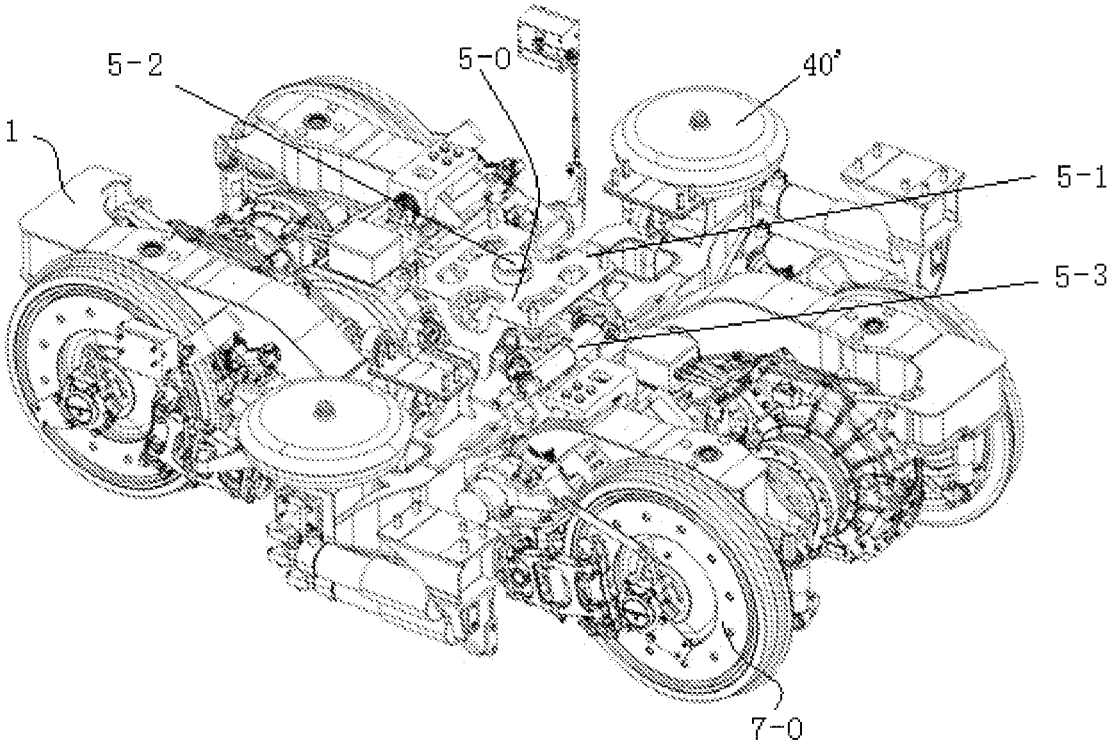
FIG. 13 is a schematic perspective view of the bogie in an embodiment of the present application.

In a specific embodiment, the elastic suspension mechanism includes three rubber nodes, and a center of a triangle formed by connecting the three rubber nodes coincides with a center of gravity of the drive system. As shown in FIG. 12, the three rubber nodes are respectively a first rubber node 8-*a*, a second rubber node 8-*b* and a third rubber node 8-*c*. The drive system is connected to the two longitudinal beam main bodies on two sides of the frame by elastic suspension of the three rubber nodes. As shown in FIG. 4, in order to realize the arrangement of one of the three rubber nodes, a bending box body section 120 bent inward is provided at an end of one of the two longitudinal beam main bodies, the third rubber node 8-*c* is arranged at the bending box body section 120, the second rubber node 8-*b* is arranged on the inner side of the same longitudinal beam main body, and the first rubber node 8-*a* may be located on the other longitudinal beam main body. That is, the first rubber node 8-*a* and the third rubber node 8-*c* are located on the same longitudinal beam main body, and the second rubber node 8-*b* is located on the other longitudinal beam main body.

The bogie in the above embodiments further includes a central suspension device, which includes an anti-roll torsion bar and vertical pulling rods arranged at two ends of the anti-roll torsion bar. Another end of each of the vertical pulling rods is connected to a bolster above the frame through a through hole on a corresponding side of the transverse beam main body 20. The anti-roll torsion bar and the vertical pulling rods are not marked herein, which may not affect those skilled in the art understanding and implementing the technical solution herein.

The central traction device 5-0 of the bogie according to the present application includes a traction beam 5-1, a traction pin 5-2 and traction pulling rods 5-3 which are located above the frame, two traction pulling rods 5-3 are provided, a hinge seat hinged to one end of the two traction pulling rods 5-3 is provided on an inner side of each end of the traction beam 5-1 another end of the two traction pulling rods 5-3 is hinged to a hinge seat arranged at the transverse beam main body of the frame, and the two traction pulling rods 5-3 are located on two sides of the traction beam 5-1. The central traction device is located above the frame, the traction beam 5-1 is substantially Z-shaped. A height of the central traction device of this structure is relatively low, which reduces the occupation of vertical space. The traction beam 5-1 the traction pin 5-2 and the traction pulling rods 5-3 are not shown in the drawings, which may not prevent those skilled in the art from understanding the technical solution herein.

A specific embodiment of the frame of the bogie is provided herein.

Referring to FIG. 1 to FIG. 7, in a specific embodiment, the frame includes one transverse beam assembly and two longitudinal beam assemblies. The transverse beam assembly includes a transverse beam main body 20, and the transverse beam main body 20 has a box-shaped structure; that is, the transverse beam main body 20 has a hollow interior. Each of the two longitudinal beam assemblies includes a box-shaped longitudinal beam main body, and the two longitudinal beam bodies are respectively welded to two ends of the transverse beam main body 20, and the transverse beam main body 20 and the two longitudinal beam main bodies form an H-shape. The transverse beam main body 20 is located substantially in the middle of the two longitudinal beam main bodies.

In order to describe the technical solution concisely, the two longitudinal beam main bodies herein are defined as a first longitudinal beam main body 11 and a second longitudinal beam main body 12, the transverse beam main body is located between the first longitudinal beam main body 11 and the second longitudinal beam main body 12. An upper cover plate of the first longitudinal beam main body 11 is defined as a first upper cover plate 112, and an upper cover plate of the second longitudinal beam main body 12 is defined as a second upper cover plate 121. Shapes of the first upper cover plate 112 and the second upper cover plate 121 are the same. Lower cover plates of the two longitudinal beam main bodies can make reference to the structure of the upper cover plates, which is not shown in the drawings, and does not affect those skilled in the art understanding the technical solution herein.

Each of the two longitudinal beam main bodies includes an intermediate connecting section. The intermediate connecting section includes an upper cover plate, a lower cover plate, an inner side plate and an outer side plate. Partial side edges of the upper cover plates extend inward to form a partial upper wall of a box body of the transverse beam main body 20, and partial side edges of the lower cover plates extend inward to form a partial lower wall of the box body of the transverse beam main body 20.

It can be seen from the above description that, compared with the transverse beam main body 20 being a circular pipe, a connecting portion of the transverse beam main body 20 is formed by the same upper cover plate and the lower cover plate with the longitudinal beam main body, a connection between the transverse beam main body 20 and the longitudinal beam main body is gradually transitioned, which avoids a sudden change of a connecting section between the transverse beam main body 20 and the longitudinal beam main body, greatly reduces the strength of the connection between the transverse beam main body 20 and the longitudinal beam main body, and improves the use safety of the frame.

In addition, a mounting seat for mounting the axle box according to the present application is arranged on the inner side of the longitudinal beam main body, so that a distance between the two longitudinal beam main bodies can be reduced as much as possible. Tests have confirmed that by placing the mounting seat of the axle box on the inner side of the longitudinal beam main body, the center distance between the two longitudinal beam main bodies can be reduced to within 1200 mm. In a specific embodiment, the center distance between the two longitudinal beam main bodies may range from 1120 mm to 1150 mm, which greatly improves the flexibility of the frame.

The above center distance herein refers to a distance between longitudinal center planes of the first longitudinal beam main body 11 and the second longitudinal beam main body 12.

Figure 5:
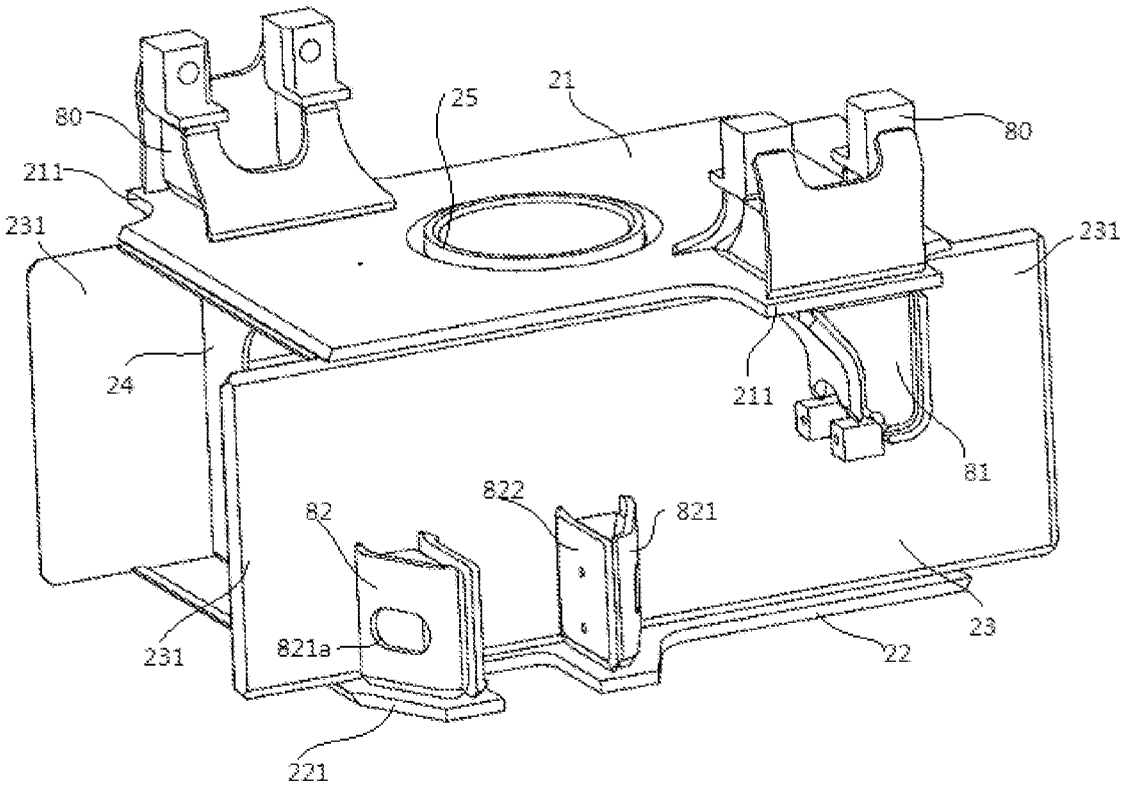
FIG. 5 is a schematic structural view of a transverse beam assembly in a specific embodiment of the present application.
Figure 6:
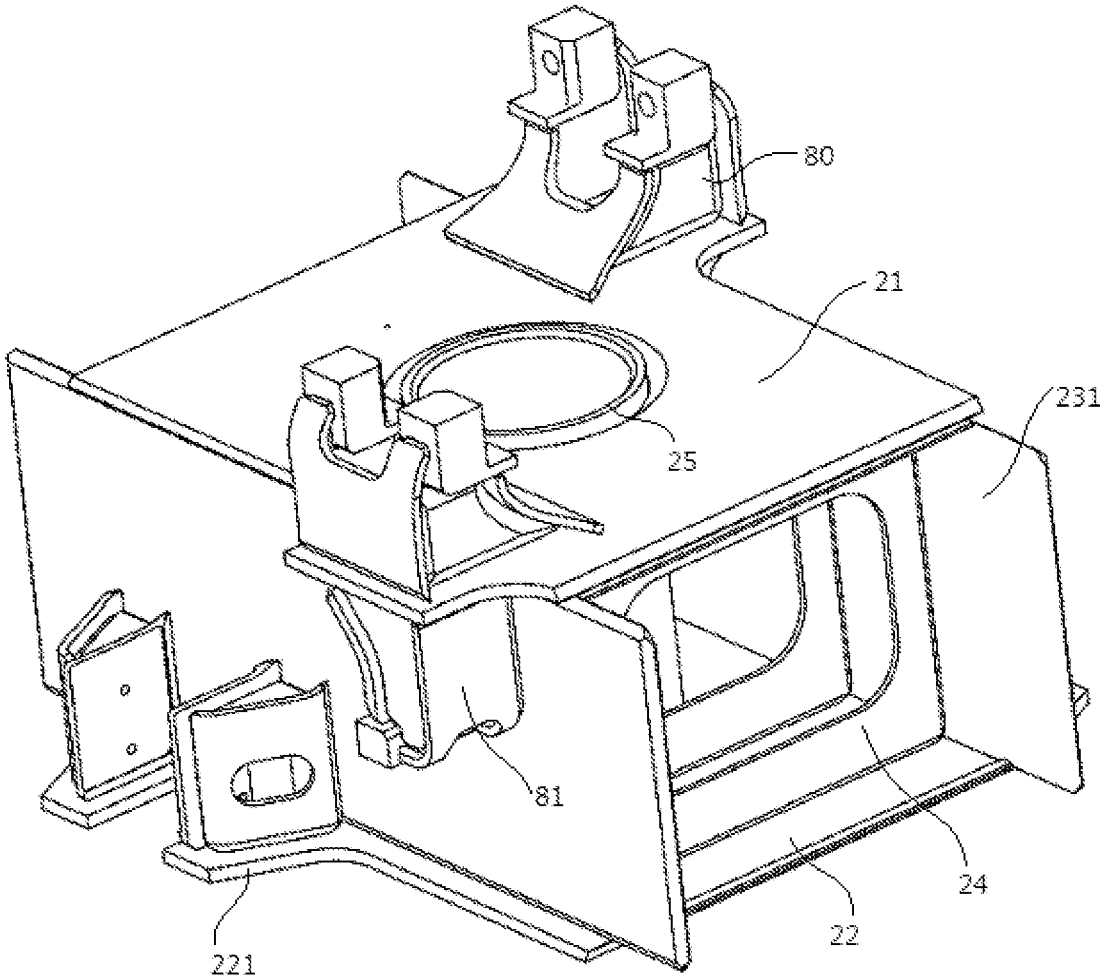
FIG. 6 is a schematic structural view of the transverse beam assembly in FIG. 5 in another direction.
Figure 7:
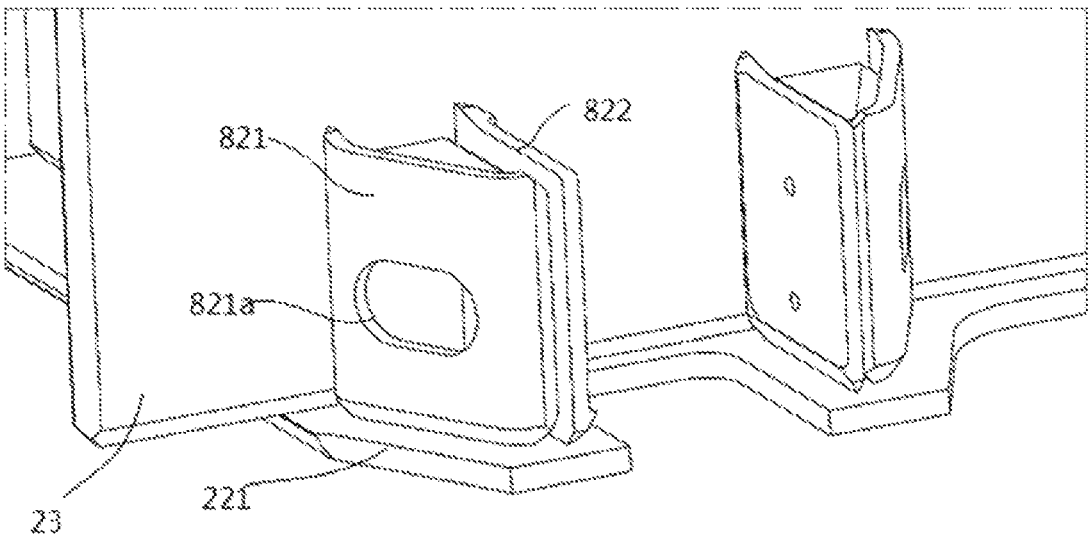
FIG. 7 is a partial enlarged view of the structure shown in FIG. 6.

In a specific embodiment, the transverse beam main body 20 includes an upper plate body 21, a lower plate body 22 and two vertical plates 23 which form a box body structure. Two ends of the two vertical plates 23 extend to outer sides of corresponding ends of the upper plate body 21 and the lower plate body 22; that is, lengths of the upper plate body 21, the lower plate body 22 and the two vertical plates 23 which form the transverse beam main body 20 are different, the lengths of the two vertical plates 23 are larger than the lengths of the upper plate body 21 and the lower plate body 22, and the two vertical plates 23 extend out from outer ends of the upper plate body 21 and the lower plate body 22. As shown in FIG. 5, two ends of each of the two vertical plates 23 have an extending section 231, and the extending sections 231 extend out from the corresponding outer ends of the upper plate body 21 and the lower plate body 22.

The partial side edges of the upper plates of the two longitudinal beam main bodies extend inward to form a first inner extension section, and the part side edges of the lower cover plates extend inward to form a second inner extension section. The first inner extension section and the second inner extension section are respectively butt welded to the upper plate body 21 and the lower plate body 22 of the transverse beam main body 20; the two vertical plates 23 are welded to the inner side plate on corresponding sides of the intermediate section. For example, FIG. 4 shows a second upper cover plate 121 and a lower cover plate 122 of the transverse beam main body 20, and a first inner extension section 1211 of the second upper cover plate 121 and a second inner extension section 1221 of the lower cover plate 122 can be seen in FIG. 4.

In this embodiment, the first inner extension section of the upper cover plate of the longitudinal beam main body extends between the two vertical plates, an end is butt welded to the upper plate body of the transverse beam main body, and two sides of the first inner extension section are welded to corresponding positions of the two vertical plates. Similarly, the second inner extension section of the lower cover plate of the longitudinal beam main body is also located between the two vertical plates, the second inner extension section 1221 is butt welded to the lower plate body of the transverse beam main body 20, and two sides of the second inner extension section are welded to corresponding positions of the two vertical plates. In this way, a connection between the transverse beam main body 20 and the longitudinal beam main body also forms a box-shaped structure, and the connection changes continuously, which further increases the use strength of the frame. On the basis of the above embodiments, the two upper cover plates are respectively fixed to a first transverse stop block 71 and a second transverse stop block 72, the first transverse stop block 71 and the second transverse stop block 72 respectively define two extreme positions of transverse movement of the vehicle body.

The first transverse stop block 71 and the second transverse stop block 72 may be arranged opposite, and shapes are not limited as long as they can limit the transverse movement of the vehicle body.

In a specific embodiment, the frame 1 further includes a supporting pipe 60 transversely penetrating each of the two longitudinal beam main bodies. An inner end of the supporting pipe 60 penetrates through each of the longitudinal beam main bodies to form a first gearbox hanger 61, and the supporting pipe 60 extends outward to an outer side of each of the longitudinal beam main bodies to form a brake hanger 62 and a height valve mounting seat 63, the height valve mounting seat 63 is configured to mount a height valve, and structures of the brake hanger 62 and the height valve mounting seat 63 are not limited.

In this embodiment, the first gearbox hanger 61, the brake hanger 62 and the height valve mounting seat 63 are integrated, so as to optimize the structure of the frame and improve the assembly flexibility.

In the above embodiments, one end of each of the two longitudinal beam main bodies is bent inward to form a bending box body section, the bending box body section has an opening facing the first gearbox hanger, a second gearbox hanger is provided at the opening, the first gearbox hanger and the second gearbox hanger on the same side form a hanger of the gearbox together. The bending box body sections of the two longitudinal beam main bodies are located at two ends, that is, the bending box body sections of the two longitudinal beam main bodies are not located at the same end.

Figure 2:
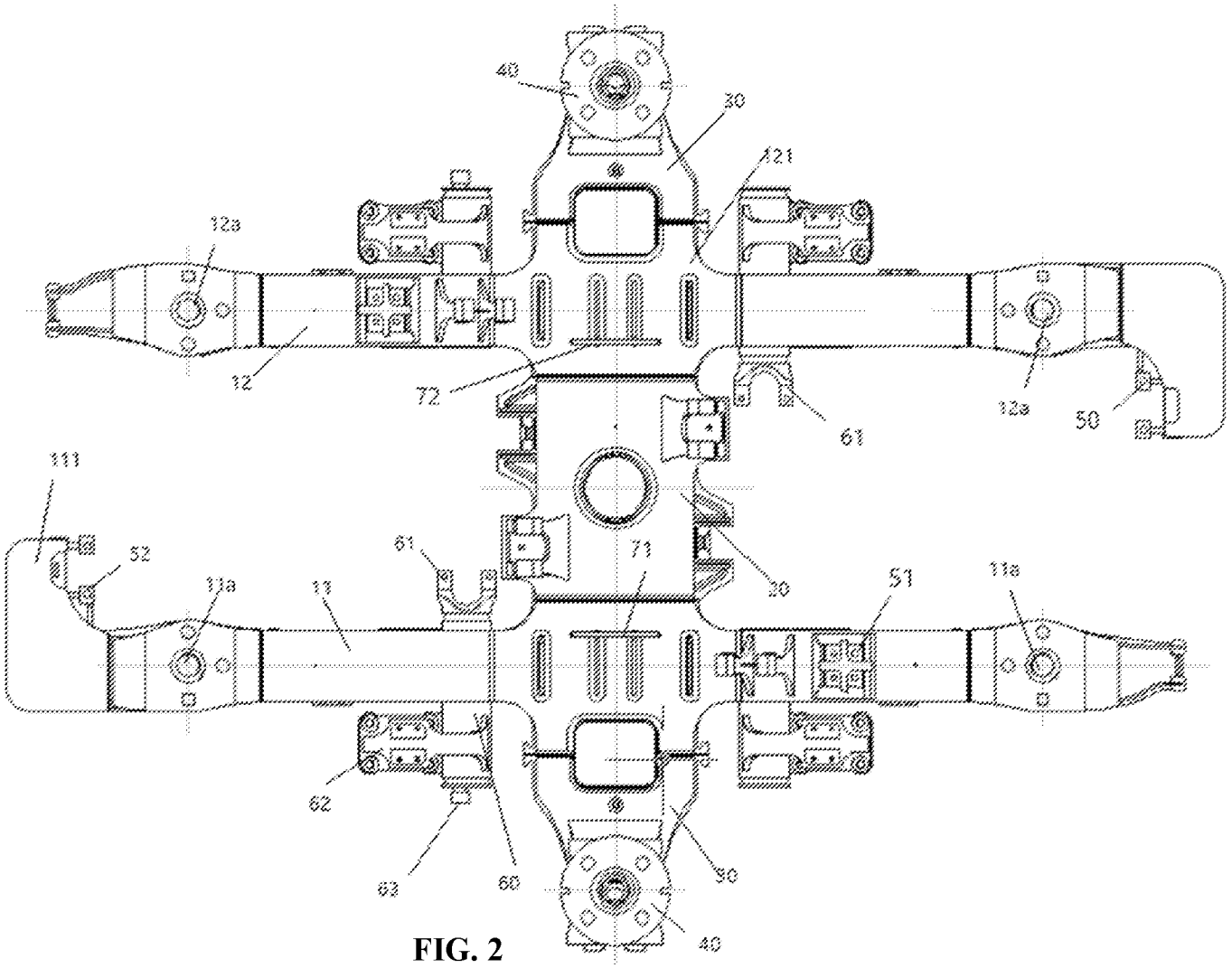
FIG. 2 is a top view of the frame in FIG. 1.
Figure 3:
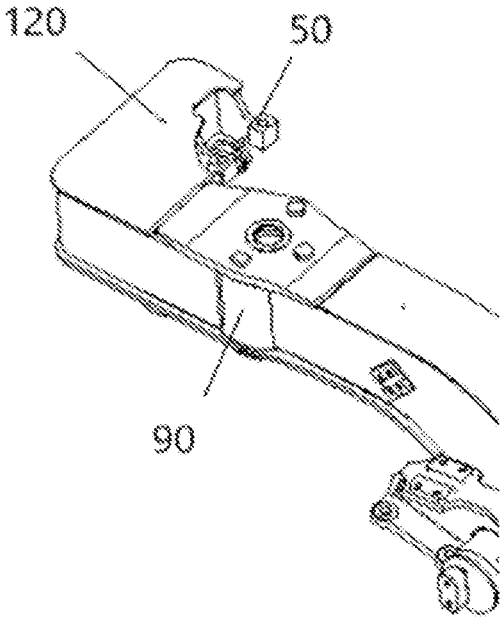
FIG. 3 is a partial schematic view of the frame in FIG. 1.

As shown in FIG. 1 and FIG. 2, a bending box body section 111 of the first longitudinal beam main body is located at a left end, and a bending box body section 120 of the second longitudinal beam main body is located at a right end. The left end and the right end are described in terms of the relative positional relationship between the components in FIG. 1 and FIG. 2. A second gearbox hanger 50 for mounting the third rubber node 8-*c*, is provided inside the bending box body section 111 of the first longitudinal beam main body, and a first gearbox hanger 61 for mounting the second rubber node 8-*b*, is also provided on an inner side of the first longitudinal beam main body 11, which together form the hanger of the gearbox.

Similarly, the bending box body section 120 of the second longitudinal beam main body is internally provided with a second gearbox hanger 50, which forms mounting and connecting positions of the three rubber nodes of the drive system 8-0 for mounting and connecting the three rubber nides with a first gearbox hanger 61 on an inner side of the second longitudinal beam main body 12 and a motor hanger 51 on the first longitudinal beam main body, so as to realize the elastic suspension of the drive system 8-0.

In this embodiment, on one hand, the bending box body section can enhance the supporting strength of the longitudinal beam main body, and on the other hand, the second gearbox hanger is located inside the bending box body section of the longitudinal beam main body, which has a compact structure and reduces space occupation.

In a specific embodiment, the frame in the above embodiments may include an addition box body 30 forming a chamber. Two addition box bodies 30 are provided, which are symmetrically arranged on two sides of the longitudinal center plane, and the two addition box bodies 30 are respectively located on outer sides of the longitudinal beam main body, the chamber of the addition box body 30 is in communication with an air chamber inside the corresponding longitudinal beam main body. An air spring mounting seat 40 is provided outside a top wall of the addition box body 30, and an inlet and an outlet communicated through the chamber are defined in the addition box body 30. The inlet of the addition box body 30 is in indirect or indirect communication with an air source, and the outlet is in communication with an air spring 40'. Generally, an inner chamber of the intermediate connecting section may be arranged as an air box, and the air chamber of the intermediate connecting section is in communication with the chamber of the addition box body 30, to jointly form a storage space for the air source required for the operation of the air spring 40'.

In a specific embodiment, the upper cover plate and the lower cover plate respectively include a first outer extension section and a second outer extension section which extend transversely outside the outer side plate. A top wall and a bottom wall of the addition box body 30 are respectively butt welded to the first outer extension section and the second outer extension plate, and inner ends of other two side walls are welded to the outer side plate.

In other words, the upper cover plate and the lower cover plate respectively form the partial top wall and the partial bottom wall of the addition box body 30, so that the addition box body 30 and the longitudinal beam main body can be integrated, and a structure of the addition box body 30 and the longitudinal beam main body is more compact.

In the above embodiments, a motor hanger 51 and a motor hanger stopper are provided on the two vertical walls of the transverse beam main body. The motor hanger 51 is configured to mount the first rubber node 8-*a*. After the motor hanger stopper is mounted, a center of the motor hanger stopper is the same as a height of the motor, so as to avoid increasing the torque.

Specifically, a spring sleeve 90 for mounting a primary rubber is provided on each of the two longitudinal beam bodies. A lower end of the spring sleeve 90 is open and includes a pipe section arranged outside a bottom wall of the longitudinal beam body. An upper end of the spring sleeve 90 is welded to an inner surface of a top wall of the longitudinal beam body. Two spring sleeves 90 are provided, which are symmetrical about a transverse center plane of the longitudinal beam body.

A through hole is further provided on the top wall of the longitudinal beam body corresponding to the spring sleeve 90, so as to facilitate the fixing of the spring sleeve. Referring to FIG. 2, a through hole 11*a* is defined on the first longitudinal beam main body 11, and a through hole 12*a* is defined on the second longitudinal beam main body 12.

In the above embodiments, the frame further comprises a traction pulling rod seat 80. The traction pulling rod seat 80 is configured to mount one end of a longitudinal pulling rod of the primary suspension, and the upper plate body 21 of the transverse beam main body 20 has a first extending portion 211 extending longitudinally and extending out of an outer wall of the corresponding vertical plate 23, and the traction pulling rod seat 80 is at least partially mounted on an upper surface of the first extending portion 211, which can realize the compact structure as much as possible under the premise of realizing the mounting of the longitudinal pulling rod of the primary suspension. Generally, two traction pulling rod seats 80 are provided in the longitudinal direction, which are respectively located at the two ends of the transverse beam main body 20. The specific position may be determined according to the actual vehicle model. A specific structure of the traction pulling rod seats 80 are not specifically limited.

In a specific embodiment, the frame further includes a motor transverse shock absorber seat 81 with a structure for limiting the transverse vibration displacement of the motor. The motor transverse shock absorber seat 81 is mounted on a lower surface of the first extending portion 211. In this embodiment, the structure is more compact, and other space positions are not occupied, which is beneficial to the optimization of the overall structure.

Further, the lower plate body 22 in the above embodiments has a second extending portion 221 extending longitudinally to an outer wall of a corresponding side of the vertical plate 23, a motor transverse stopper seat 82 is provided on an upper surface of the second extending portion 221, the motor transverse stopper seat is welded and fixed to an outer side wall of the corresponding vertical plate, and a hoisting hole is defined on the motor transverse stopper seat 82.

In other words, the motor transverse stopper seat according to the present application not only realizes the transverse limit of the motor, but also has the function of hoisting cooperation, that is, a hoisting device can realize the hoisting of the frame by connecting the hoisting holes.

Specifically, the motor transverse stopper seat 82 includes two assemblies, the two assemblies are spaced at a predetermined distance, each of the two assemblies includes a first plate 821 and a second plate 822 which define a chamber structure, a lower surface of the first plate is welded to the second extending portion 221, a rear end of the first plate is welded to the vertical plate 23, upper ends of the first plate 821 and the second plate 822 are welded and fixed, a hoisting hole 821*a* is defined on the first plate 821, and the second plate 822 cooperates with the motor for position limiting.

In this embodiment, the first plate 821 and the second plate 822 form a chamber structure, which can reduce the overall weight as much as possible under the premise of realizing hoisting and stopping.

Coaxial through holes are provided on the upper plate body 21 and the lower plate body 22 of the transverse beam main body 20, and a steel pipe is mounted inside the through holes, and reinforcing ribs 24 are provided inside the box-shaped structure. Components of the central traction device located above and below the transverse beam main body 20 are connected through the through holes arranged on the transverse beam main body 20, which greatly improves the flexibility of the arrangement of the central traction device. In addition, the reinforcing ribs 24 inside the box-shaped structure increases the use strength of the transverse beam main body 20.

Figure 8:
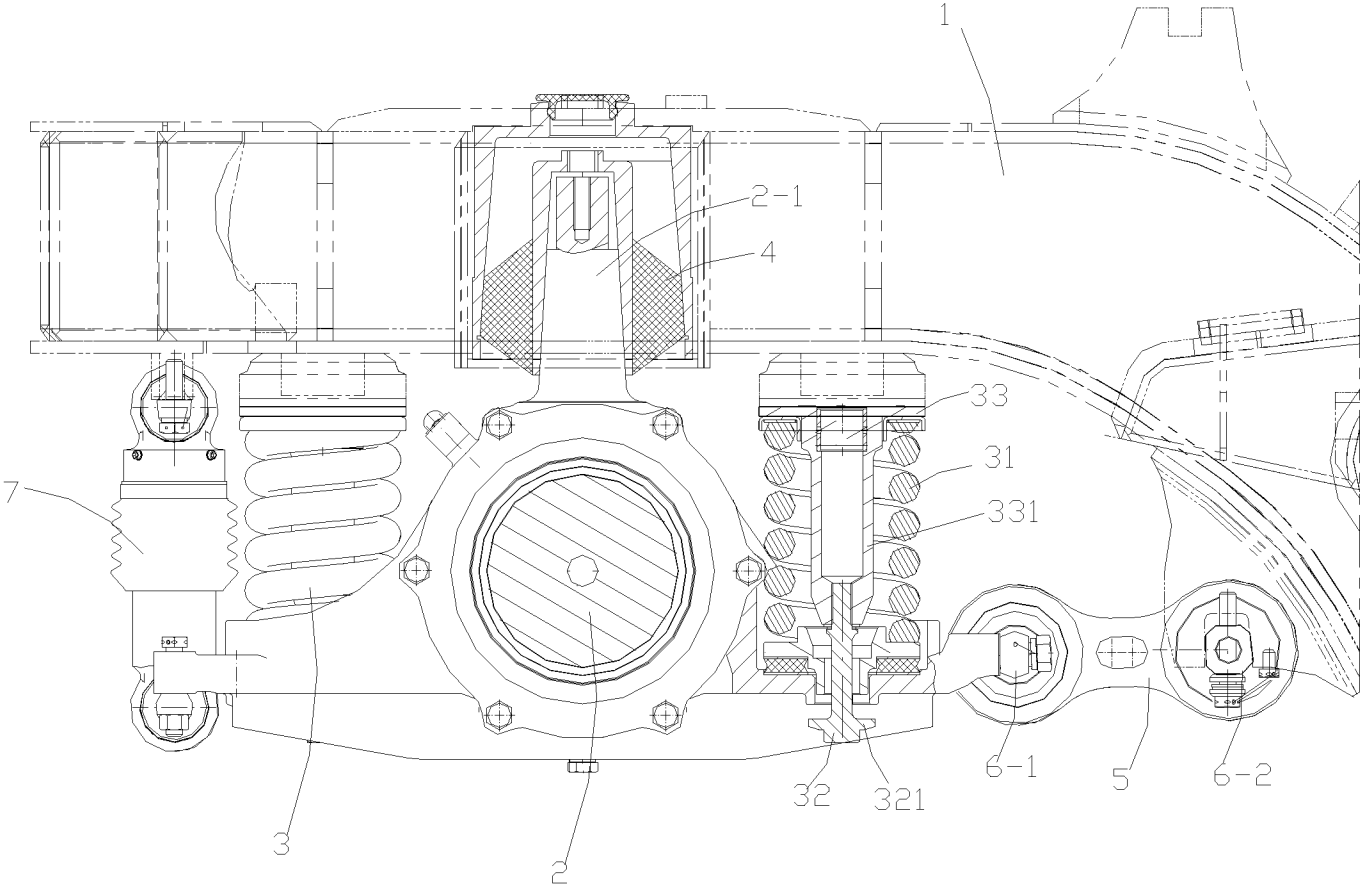
FIG. 8 is a schematic structural view of a partial structure of a bogie in an embodiment of the present application.
Figure 9:
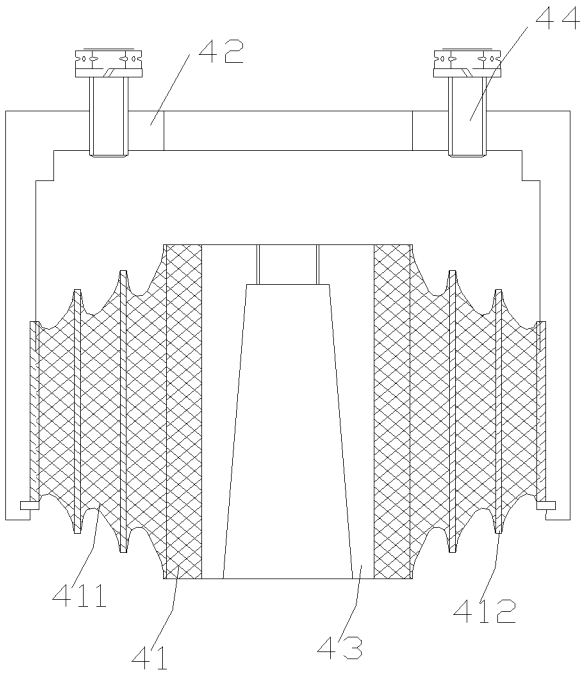
FIG. 9 is a schematic sectional view of a rubber assembly in an embodiment of the present application.

Referring to FIG. 8 and FIG. 9, the axle box 2 of the bogie of the rail vehicle is mounted on the axle of the wheelset, and the above axle box 2 is connected to the frame 1 by the primary suspension device.

The primary suspension device according to the present application includes at least a spring assembly 3, a rubber assembly 4 and a pulling rod 5.

Two spring assemblies 3 are provided, which are respectively arranged on two sides of the axle box 2, and the two spring assemblies 3 are symmetrical about a central axis of the axle box 2. In order to illustrate the technical solution simply, the two spring assemblies 3 are defined as a first spring assembly 3 and a second spring assembly 3 respectively, and the first spring assembly 3 and the second spring assembly 3 are respectively located on a front side and a rear side of the axle box 2. Each of the two spring assemblies 3 includes a tray and a main spring 31, and the tray is fixedly connected to a side wall of the axle box 2. Alternatively, the tray may be directly formed on the axle box 2, that is, the tray is integrally formed with the axle box 2. The main spring 31 is vertically arranged between the tray and the frame 1.

Taking the second spring assembly 3 as an example, the second spring assembly 3 includes the tray and the main spring 31, a mounting seat is provided on the frame 1, and the main spring 31 is pressed between the tray and the mounting seat of the frame 1. A specific connection method of the main spring 31 and the frame 1 may be described in detail later.

The tray can be arranged on a bottom wall of the axle box 2 as much as possible, so that a mounting space of the spring assembly 3 can be enlarged as much as possible.

The rubber assembly 4 according to the present application is arranged between the top wall of the axle box 2 and the frame 1, that is, the rubber assembly 4 is located above the axle box 2. The rubber assembly 4 includes a framework 42 and a rubber body 41 mounted on the framework 42, and the framework 42 includes a mounting structure for cooperating and fixing with the frame 1, that is, the framework 42 is fixedly mounted on the frame 1 by a mounting structure provided thereon. For example, the mounting structure includes a bolt, or the mounting structure may have other structure, such as the framework 42 is fixed to the frame 1 by welding.

The rubber body 41 includes a cooperating structure positioned on the top wall of the axle box 2, and the rubber body 41 is vertically positioned to the axle box 2 by a fixing member, so as to prevent the rubber body 41 from being separated from the axle box 2.

The pulling rod 5 according to the present application is arranged longitudinally, and two ends of the pulling rod 5 are respectively hinged to the axle box 2 and the frame 1, and the pulling rod 5 is configured to provide a longitudinal rigidity.

The spring assembly 3 in the primary suspension device provided according to the present application is vertically arranged between the axle box 2 and the frame 1, which can provide a vertical rigidity. Two spring assemblies 3 are provided and are respectively arranged on a side of the axle box 2 as much as possible, so that connection points between the two spring assemblies 3 and the axle box 2 is arranged as close to the bottom of the axle box 2, and the arrangement space of the two spring assemblies 3 is appropriately increased, which is beneficial to arranging the spring assembly 3 with a high rigidity. The rubber assembly 4 is provided in an axial positioning device according to the present application, and the rubber assembly 4 is mounted between the top wall of the axle box 4 and the frame 1, which can further provide the vertical rigidity and the transverse rigidity. By reasonably arranging the spring assembly 3 and the rubber assembly 4, different rigidity requirements for use can be met, and the use flexibility is improved.

In a specific embodiment, a mounting hole extending vertically is defined on the rubber body 41, at least a lower end of the mounting hole has an open structure, and at least part hole section of the mounting hole cooperates with a mounting protruding column 2-1 arranged on the top wall of the axle box 2. That is, the mounting protruding column 2-1 is provided on a top wall of an axial body, the mounting protruding column 2-1 may be cylindrical, which may be entirely mounted inside the mounting hole on the rubber body 41, or an upper column section may be mounted inside the mounting hole. In a specific embodiment, an outer wall of a cooperating section of the mounting protruding column 2-1 is a tapered structure, and a size of the cooperating section gradually decreases from top to bottom.

A specific structure of the mounting protruding column 2-1 is not limited to the description herein, and can also be other structure, as long as it can cooperate with the mounting hole of the rubber body 41 to realize the use requirements for the vertical rigidity and the transverse rigidity.

In the above embodiments, the mounting protruding column 2-1 on the top wall of the axle box 2 is inserted into the rubber body 41, which can realize a reliable combination of the axle box 2 and the rubber body 41, facilitate realizing the arrangement of the rubber body 41 with a high rigidity in a limited space, and has a better reliability of force transmission.

Specifically, the mounting hole has a through-hole structure and is internally combined with a rigid sleeve 43, the rigid sleeve 43 includes a top wall and a cylindrical body extending downward from an outer edge of the top wall, a lower end of the cylindrical body is open, an outer wall of the cylindrical body is combined with an inner wall of the mounting hole, at least part hole section of an inner hole of the cylindrical body is in an interference fit with the mounting protruding column, the top wall of the rigid sleeve 43 is fixedly connected to the mounting protruding column 2-1 by a fixing member.

The fixing member may be a component such as a screw 44.

Furthermore, the rubber body 41 in the above embodiments may include multiple rubber blocks 411 and rigid bodies 412 arranged between adjacent rubber blocks 411, a size of a whole formed by combining the multiple rubber blocks 411 and the multiple rigid bodies 412 gradually increases from two ends to the middle, that is, a radial size at the middle of the rubber body 41 is large, and radial sizes at the two ends is small, so that the positioning requirements for small vertical rigidity and large horizontal rigidity can be met. The two ends of the rubber body 41 are respectively fixed to a corresponding inner wall of the framework 42.

The multiple rubber blocks 411 and the multiple rigid bodies 412 may be integrally formed by a vulcanization process. The number of the rubber blocks 411 may be determined by the specific environment in which they are applied.

The structure of the combination of the multiple rubber blocks 411 and the multiple rigid bodies 412 can provide a certain rigidity while realizing the shock absorption effect of the rubber blocks 411.

In the above embodiments, each of the two spring assemblies 3 includes a limiting rod 32, an upper end of the limiting rod 32 is fixedly connected to the frame 1, a lower end passes through the tray, a limiting block 321 for limiting the limiting rod 32 from separating from the tray is provided on a rod section of the limiting rod 32 located below the tray, that is, a size of the limiting block 321 is larger than a size of a through hole on the tray for the limiting rod 32 to pass through. In addition, in a normal state, a predetermined distance is present between the limiting block 321 and a bottom wall of the tray, which allows the spring to have a predetermined amount of movement in the vertical direction.

The limiting block 321 has two functions. On one hand, it can prevent the spring from being excessively elongated so as to realize the protection for spring; on the other hand, when the frame 1 is hoisted, under the limit of the limiting rod 32 and the tray, the axle box 2, the spring assembly 3 and other components can move upward with the frame 1 to realize the hoisting.

Furthermore, each of the two spring assemblies 3 further includes an upper mounting plate 33. The upper mounting plate 33 includes a column body 331 extending vertically, and a specific length of the column body 331 can be set according to the specific use environment. An upper end of the limiting rod 32 is an external thread section, and an internal thread section, connected to the external thread section, is provided on the column body 331. The column body 331 has a cylindrical structure with openings at two ends, and an internal thread section is provided on an inner wall of the cylindrical structure. During mounting, the external thread section of the limiting rod 32 is connected to the internal thread section on the column body 331 through the tray. An upper end of the column body 331 is fixedly connected to the frame 1, and the main spring 31 is mounted on a periphery of the column body 331.

On one hand, the column body 331 can realize the mounting of the limiting rod 32, and on the other hand, the column body 331 plays a guiding role for compression or extension of the main spring 31, which makes the main spring 31 always move in the vertical direction.

In the above embodiment, the primary suspension device further includes an adjusting gasket, and the adjusting gasket is arranged between the upper mounting plate 33 and the frame 1. A downward pulling force is exerted by the limiting rod, which drives the upper mounting plate 33 to move downward, and compresses the main spring 31, so that the upper mounting plate 33 is separated from the frame 1. In addition, the adjusting gasket is inserted between the upper mounting plate 33 and the frame 1, so as to realize the height adjustment of the main spring 31.

In the above embodiments, the primary suspension device may include an active vertical shock absorber 7 which is vertically arranged on a side of the axle box 2, an upper end of the active vertical shock absorber 7 is hinged to the frame 1, and a lower end is hinged to a supporting seat fixed to a side wall of the axle box 2. The active vertical shock absorber 7 can realize large damping at low frequency and small damping at high frequency, so that the vibration can be rapidly attenuated.

A structure of the active vertical shock absorber 7 may be the same as the existing structure, which is not further limited herein.

In a specific embodiment of the present application, the main spring 31 is designed in a height-adjustable form, which further increases the flexibility of the device.

Referring to FIG. 8, in the above embodiments, one pulling rod 5 is provided, a front end of the pulling rod 5 is hinged to the tray by a hinge seat, a rear end of the pulling rod 5 is hinged to the frame 1 by a hinge seat, as shown in FIG. 8, the front end of the pulling rod 5 is hinged to the tray by a first hinge seat 6-1, and the rear end of the pulling rod 5 is hinged to the frame 1 by a second hinge seat 6-2. The first hinge seat 6-1 and the second hinge seat 6-2 may have a same structure or different structures. A specific embodiment in which the first hinge seat and the second hinge seat have the same structure is given herein.

Figure 10:
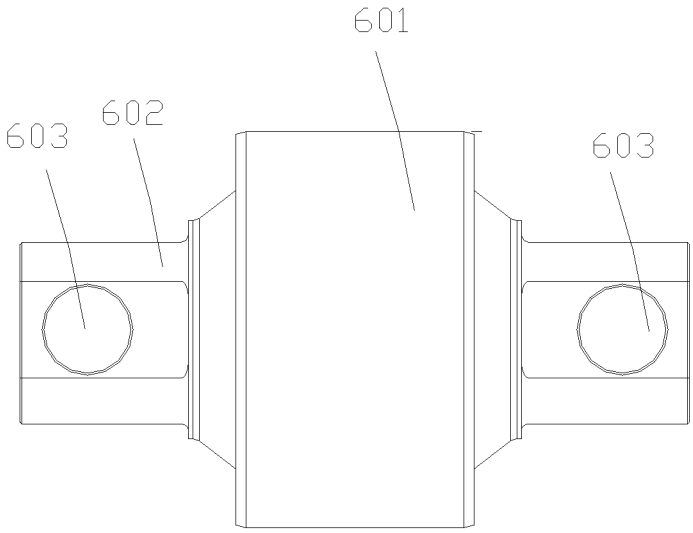
FIG. 10 is a schematic structural view of a hinge seat in an embodiment of the present application.
Figure 10:
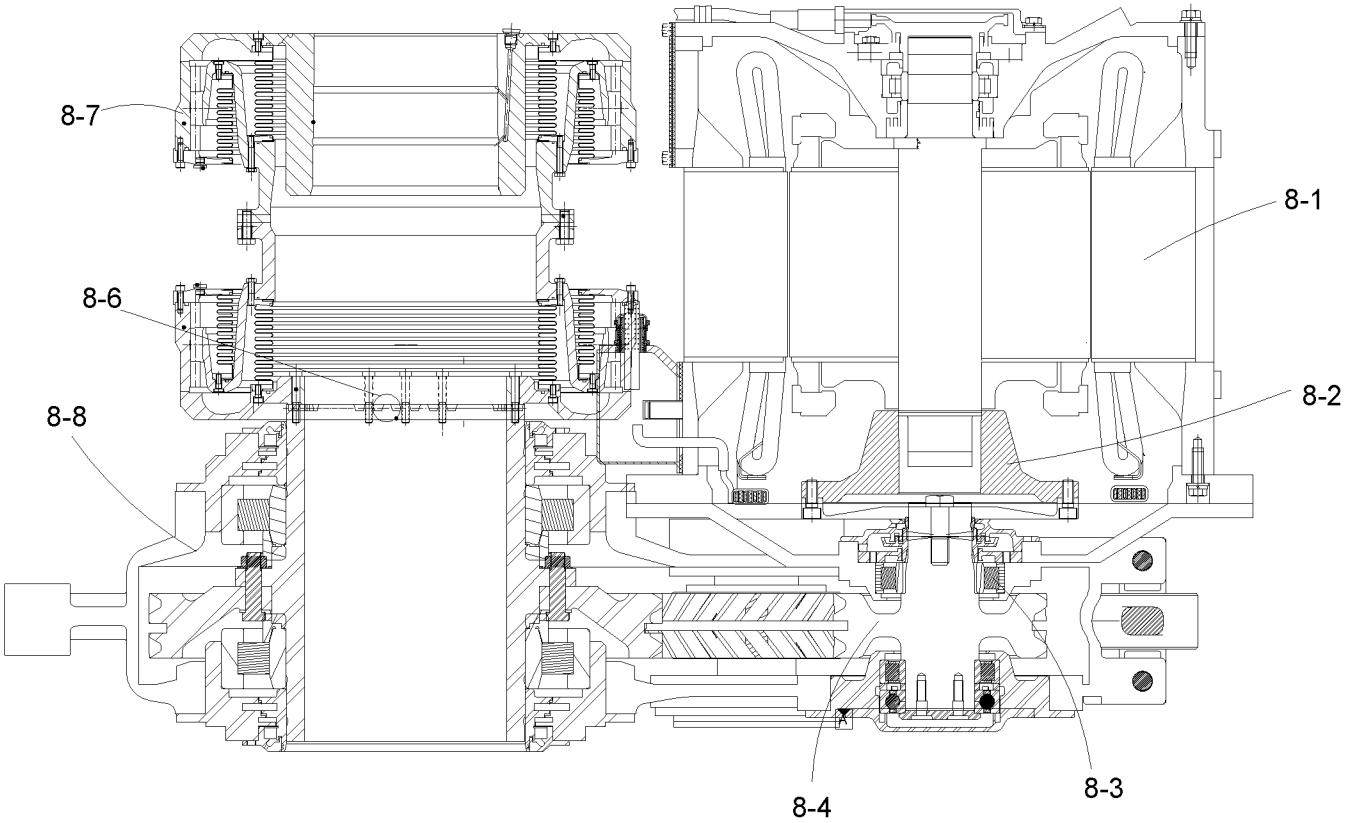

Referring to FIG. 10, in a specific embodiment, each of the hinge seats at two ends of the pulling end 5 includes an elastic body 601 and a rigid hinge rod 602, the rigid hinge rod 602 is partially combined inside the elastic body 601 and two ends of the rigid hinge rod 602 extend out of the elastic body 601, a hinge hole 603 is defined at the two ends of the rigid hinge rod 602, a mounting through hole is defined at the two ends of the pulling rod 5, and during mounting, the elastic body is tensioned and mounted inside the mounting through hole, and the hinge hole of the hinge seat hinged to the tray is axially longitudinal, that is, an axial direction of the hinge hole between the first hinge seat and the tray is longitudinal. The hinge hole of the hinge seat hinged to the frame 1 is axially vertical, that is, an axial direction of the hinge hole between the second hinge seat and the frame 1 is vertical.

In the above embodiments, a length of the pulling rod satisfies the following conditions: the moment of a longitudinal force exerted by the pulling rod 5 on the tray relative to a center of the wheels is balanced against the moment of a longitudinal force exerted by the rubber body 41 on the axle box 2 relative to the center of the wheels.

The bogie provided according to the present application includes the primary suspension device described in any one of the above, the tray is fixed at the bottom of the axle box 2, the through hole is defined on the frame 1 and the rubber body 41, so as to mount the fixing member between the rubber body 41 and the top wall of the axle box 2.

A rail vehicle is further provided according to the present application, which includes a bogie and a vehicle body, and the bogie is the bogie according to any one of the above.

The rail vehicle according to the present application includes the bogie in the above embodiments, so it has the above technical effects of the bogie.

Other structures of the rail vehicle may not be described in further detail, which can make reference to the prior art.

The railway vehicle and the bogie thereof provided according to the present application have been described in detail above. The principle and the embodiments of the present application are illustrated herein by specific examples. The above description of examples is only intended to facilitate the understanding of the method and spirit of the present application. It should be noted that, for those skilled in the art, many improvements and modifications may be further made to the present application without departing from the principle of the present application, and these improvements and modifications also fall within the protection scope of claims of the present application

The invention claimed is:

1. A bogie of a rail vehicle, comprising:

a frame, which comprises two box-shaped longitudinal beam main bodies and a transverse beam main body, wherein the two longitudinal beam main bodies are respectively welded to two ends of the transverse beam main body, and the transverse beam main body and the two longitudinal beam main bodies form an H-shape;

a wheelset, which comprises an axle box, an axle and wheels mounted at two ends of the axle, wherein the two longitudinal beam main bodies are located between the wheels of the wheelset, and the axle box is positioned on an inner side of the corresponding longitudinal beam main body by a primary suspension device;

a drive system, which at least comprises a gearbox and a drive motor, wherein after components constituting the drive system form as a whole, the whole is positioned on the frame by an elastic suspension mechanism, a central traction device, which comprises a traction beam, a traction pin and traction pulling rods, wherein two traction pulling rods are provided, a hinge seat hinged to one end of the two traction pulling rods is provided on an inner side of each end of the traction beam, another end of the two traction pulling rods is hinged to a hinge seat arranged at the transverse beam main body of the frame, and the two traction pulling rods are located on two sides of the traction beam.

2. The bogie of the rail vehicle according to claim 1, wherein the drive system further comprises an input end coupling, a bearing and an output end coupling; the input end coupling is fixed to an output end of the drive motor, the input end coupling and an input end of the gearbox are supported by same bearing;

and/or, end surface teeth for meshing with a corresponding end of the output end coupling are provided on an end surface of an output gear shaft of the gearbox.

3. The bogie of the rail vehicle according to claim 1, wherein the elastic suspension mechanism comprises three rubber nodes, and a center of a triangle formed by connecting the three rubber nodes coincides with a center of gravity of the drive system.

4. The bogie of the rail vehicle according to claim 1, wherein each of the two longitudinal beam main bodies comprises an intermediate connecting section, the intermediate connecting section comprises an upper cover plate, a lower cover plate, an inner side plate and an outer side plate, partial side edges of the upper cover plates extend inward to form a partial upper wall of a box body of the transverse beam main body, and partial side edges of the lower cover plates extend inward to form a partial lower wall of the box body of the transverse beam main body.

5. The bogie of the rail vehicle according to claim 4, wherein the transverse beam main body comprises an upper plate body, a lower plate body and two vertical plates which form a box body structure, two ends of the two vertical plates extend to outer sides of corresponding ends of the upper plate body and the lower plate body; the two vertical plates are welded to the inner side plate on corresponding sides of the intermediate section; the partial side edges of the upper cover plates extend inward to form a first inner extension section, the partial side edges of the lower cover plates extend inward to form a second inner extension section, the first inner extension section and the second inner extension section are respectively butt welded to the upper plate body and the lower plate body of the transverse beam main body; the two vertical plates are welded to the inner side plate on the corresponding sides of the intermediate section.

6. The bogie of the rail vehicle according to claim 5, further comprising a supporting pipe transversely penetrating each of the two longitudinal beam main bodies, wherein an inner end of the supporting pipe penetrates through the longitudinal beam main body to form a first gearbox hanger, and the supporting pipe extends outward to an outer side of the longitudinal beam main body to form a brake hanger and a height valve mounting seat.

7. The bogie of the rail vehicle according to claim 1, wherein the primary suspension device comprises the following components:

two spring assemblies, which are respectively arranged on two sides of the axle box, and the two spring assemblies are symmetrical about a central axis of the axle box; each of the two spring assemblies comprises a tray and a main spring, the tray is fixedly connected to the axle box, and the main spring is vertically arranged between the tray and the frame;

a rubber assembly, arranged between a top wall of the axle box and the frame, wherein the rubber assembly comprises a framework and a rubber body mounted on the framework, the framework comprises a mounting structure for cooperating and fixing with the frame, and the rubber body is vertically positioned on the top wall of the axle box by a fixing member;

a pulling rod for providing a longitudinal rigidity, arranged longitudinally and with two ends respectively hinged to the axle box and the frame.

8. The bogie of the rail vehicle according to claim 7, wherein a mounting hole extending vertically is defined on the rubber body, at least a lower end of the mounting hole has an open structure, and at least part hole section of the mounting hole cooperates with a mounting protruding column arranged on the top wall of the axle box.

9. The bogie of the rail vehicle according to claim 8, wherein the mounting hole has a through-hole structure and is internally combined with a rigid sleeve, the rigid sleeve comprises a top wall and a cylindrical body extending downward from an outer edge of the top wall, a lower end of the cylindrical body is open, an outer wall of the cylindrical body is combined with an inner wall of the mounting hole, at least part hole section of an inner hole of the cylindrical body is in an interference fit with the mounting protruding column, the top wall of the rigid sleeve is fixedly connected to the mounting protruding column by the fixing member;

and/or, the rubber body comprises a plurality of rubber blocks and rigid bodies arranged between adjacent rubber blocks, a size of a whole formed by combining the plurality of rubber blocks and the plurality of rigid bodies gradually increases from two ends to the middle, and two ends of the rubber body are respectively fixed to a corresponding inner wall of the framework.

10. The bogie of the rail vehicle according to claim 7, wherein each of the two spring assemblies comprises a limiting rod, an upper end of the limiting rod is fixedly connected to the frame, a lower end of the limiting rod passes through the tray, a limiting block for limiting the limiting rod from separating from the tray is provided on a rod section of the limiting rod located below the tray, and in a normal state, a predetermined distance is present between the limiting block and a bottom wall of the tray;

and/or, each of the two spring assemblies comprises an upper mounting plate, the upper mounting plate comprises a column body extending vertically, an upper end of the limiting rod is an external thread section, and an internal thread section connected to the external thread section is provided on the column body; an upper end of the column body is fixedly connected to the frame, and the main spring is mounted on a periphery of the column body.

11. The bogie of the rail vehicle according to claim 7, further comprising an active vertical shock absorber which is vertically arranged on a side of the axle box, wherein an upper end of the active vertical shock absorber is hinged to the frame, and a lower end of the active vertical shock absorber is hinged to a supporting seat fixed to a side wall of the axle box.

12. The bogie of the rail vehicle according to claim 7, wherein one pulling rod is provided, a front end of the pulling rod is hinged to the tray by a hinge seat, a rear end of the pulling rod is hinged to the frame by a hinge seat, the hinge seat comprises an elastic body and a rigid hinge rod, the rigid hinge rod is partially combined inside the elastic body and two ends of the rigid hinge rod extend out of the elastic body, a hinge hole is defined at the two ends of the rigid hinge rod, a mounting through hole is defined at two ends of the pulling rod, and during mounting, the elastic body is tensioned and mounted inside the mounting through hole, and the hinge hole of the hinge seat hinged to the tray is arranged axially longitudinal, and the hinge hole of the hinge seat hinged to the frame is arranged axially vertical.

13. A rail vehicle, comprising a bogie and a vehicle body, wherein the bogie is the bogie according to claim 1.

14. The bogie of the rail vehicle according to claim 2, wherein the primary suspension device comprises the following components:

two spring assemblies, which are respectively arranged on two sides of the axle box, and the two spring assemblies are symmetrical about a central axis of the axle box; each of the two spring assemblies comprises a tray and a main spring, the tray is fixedly connected to the axle box, and the main spring is vertically arranged between the tray and the frame;

a rubber assembly, arranged between a top wall of the axle box and the frame, wherein the rubber assembly comprises a framework and a rubber body mounted on the framework, the framework comprises a mounting structure for cooperating and fixing with the frame, and the rubber body is vertically positioned on the top wall of the axle box by a fixing member;

a pulling rod for providing a longitudinal rigidity, arranged longitudinally and with two ends respectively hinged to the axle box and the frame.

15. The bogie of the rail vehicle according to claim 3, wherein the primary suspension device comprises the following components:

two spring assemblies, which are respectively arranged on two sides of the axle box, and the two spring assemblies are symmetrical about a central axis of the axle box; each of the two spring assemblies comprises a tray and a main spring, the tray is fixedly connected to the axle box, and the main spring is vertically arranged between the tray and the frame;

a rubber assembly, arranged between a top wall of the axle box and the frame, wherein the rubber assembly comprises a framework and a rubber body mounted on the framework, the framework comprises a mounting structure for cooperating and fixing with the frame, and the rubber body is vertically positioned on the top wall of the axle box by a fixing member;

a pulling rod for providing a longitudinal rigidity, arranged longitudinally and with two ends respectively hinged to the axle box and the frame.

16. The bogie of the rail vehicle according to claim 4, wherein the primary suspension device comprises the following components:

two spring assemblies, which are respectively arranged on two sides of the axle box, and the two spring assemblies are symmetrical about a central axis of the axle box; each of the two spring assemblies comprises a tray and a main spring, the tray is fixedly connected to the axle box, and the main spring is vertically arranged between the tray and the frame;

a rubber assembly, arranged between a top wall of the axle box and the frame, wherein the rubber assembly comprises a framework and a rubber body mounted on the framework, the framework comprises a mounting structure for cooperating and fixing with the frame, and the rubber body is vertically positioned on the top wall of the axle box by a fixing member;

a pulling rod for providing a longitudinal rigidity, arranged longitudinally and with two ends respectively hinged to the axle box and the frame.

* * * * *